US008523378B2

(12) United States Patent
Schulzman

(10) Patent No.: US 8,523,378 B2
(45) Date of Patent: Sep. 3, 2013

(54) COMBINATION CEILING FAN AND TRACK LIGHT

(75) Inventor: Kurt Schulzman, Long Beach, CA (US)

(73) Assignee: Minka Lighting, Inc., Corona, CA (US)

( * ) Notice: Subject to any disclaimer, the term of this patent is extended or adjusted under 35 U.S.C. 154(b) by 623 days.

(21) Appl. No.: 12/715,036

(22) Filed: Mar. 1, 2010

(65) Prior Publication Data

US 2011/0211338 A1 Sep. 1, 2011

(51) Int. Cl.
*F21S 8/00* (2006.01)

(52) U.S. Cl.
USPC ..... 362/147; 362/404; 362/431; 362/432

(58) Field of Classification Search
USPC ..... 362/147, 386, 418, 419, 404, 427, 362/431, 432
See application file for complete search history.

(56) References Cited

U.S. PATENT DOCUMENTS

| | | | | |
|---|---|---|---|---|
| 5,664,957 | A * | 9/1997 | Starr | 439/207 |
| 6,146,191 | A * | 11/2000 | Kerr et al. | 439/537 |
| 6,464,524 | B1 * | 10/2002 | Kerr et al. | 439/313 |
| 6,832,902 | B2 * | 12/2004 | Gajewski et al. | 417/423.3 |
| 6,892,139 | B2 * | 5/2005 | Eisenberg et al. | 702/19 |
| 7,183,680 | B2 * | 2/2007 | Gajewski et al. | 310/68 R |
| 2004/0005218 | A1 * | 1/2004 | Marshall | 416/146 R |
| 2004/0062656 | A1 * | 4/2004 | Marshall | 416/244 R |

* cited by examiner

*Primary Examiner* — John A Ward

(74) *Attorney, Agent, or Firm* — Baker & McKenzie LLP

(57) ABSTRACT

A combination ceiling fan and track light where a support mechanism couples to the ceiling and supports the ceiling fan and the ceiling fan supplies power to the track light.

9 Claims, 2 Drawing Sheets

COMBINATION CEILING FAN AND TRACK LIGHT

CROSS REFERENCE TO RELATED APPLICATIONS

Not applicable.

FEDERALLY SPONSORED RESEARCH

Not applicable.

REFERENCE TO MICROFICHE APPENDIX

Not applicable.

FIELD OF THE INVENTION

The invention is directed to a ceiling fan, more particularly to a ceiling fan for use with a track lighting fixture.

BACKGROUND OF THE INVENTION

A typical ceiling fan includes a light fixture. The design of light fixtures for use with ceiling fans has been limited to light being reflected towards the ceiling or towards the floor from light fixtures connected directly to the ceiling fan housing. Contemporary designs of light fixtures, such as track lighting, allow the consumer to direct light in a variety of directions.

Track lighting typically requires power from a ceiling junction box. A ceiling fan also typically requires power from a ceiling junction box. Before the current invention, however, ceiling fans have not been used in combination with track lighting fixtures for a variety of reasons. First, ceiling fans require substantial support and motion stabilization to support the weight of the ceiling fan as well as the forces arising when the ceiling fan is rotating. Track lighting fixtures do not provide sufficient holding strength to support and control such forces. Second, many track lighting fixtures utilize low voltage lamps which require power conversion from standard line voltages. Ceiling fans, on the other hand, utilize standard line voltages. Thus, track lighting systems do not supply sufficient voltage to power a ceiling fan.

SUMMARY OF THE INVENTION

Embodiments of the invention provide a combination ceiling fan and track light rail having a support stem coupled to a ceiling; a hanging mechanism coupled to the support stem and a ceiling fan, the ceiling fan electrically coupled to a junction box; a track light rail electrically coupled to the ceiling fan. In some embodiments, the hanging mechanism is a standard hanger ball. The track light may be electrically coupled to the ceiling fan by one or more wires from the ceiling fan. The one or more wires may be connected to a transformer electrically coupled to the track light. The transformer preferably transforms the line voltage to track light rail voltage. The support stem may be coupled to the ceiling by the junction box. The support stem may be a hollow tube having a removable faceplate having apertures for allowing the track light rail to pass through the apertures. The support stem and hanging mechanism may be fabricated from a single piece of material. The combination ceiling fan and track light may also include a remote control capable of operating the ceiling fan and track light.

DESCRIPTION OF THE PREFERRED EMBODIMENTS

To one of skill in this art who has the benefit of this invention's realizations, teachings, disclosures, and suggestions, other purposes and advantages will be appreciated from the following description and the accompanying drawings. The following description illustrates certain preferred embodiments and is not to be used to improperly limit the scope of the invention, which may have other equally effective or legally equivalent embodiments.

Embodiments of the invention provide a support mechanism for providing a combination ceiling fan and track light. The support mechanism supports the ceiling fan which supplies the power to the track light. Where the track light utilizes a voltage different from line voltage, a converter is further included.

Figure 1:
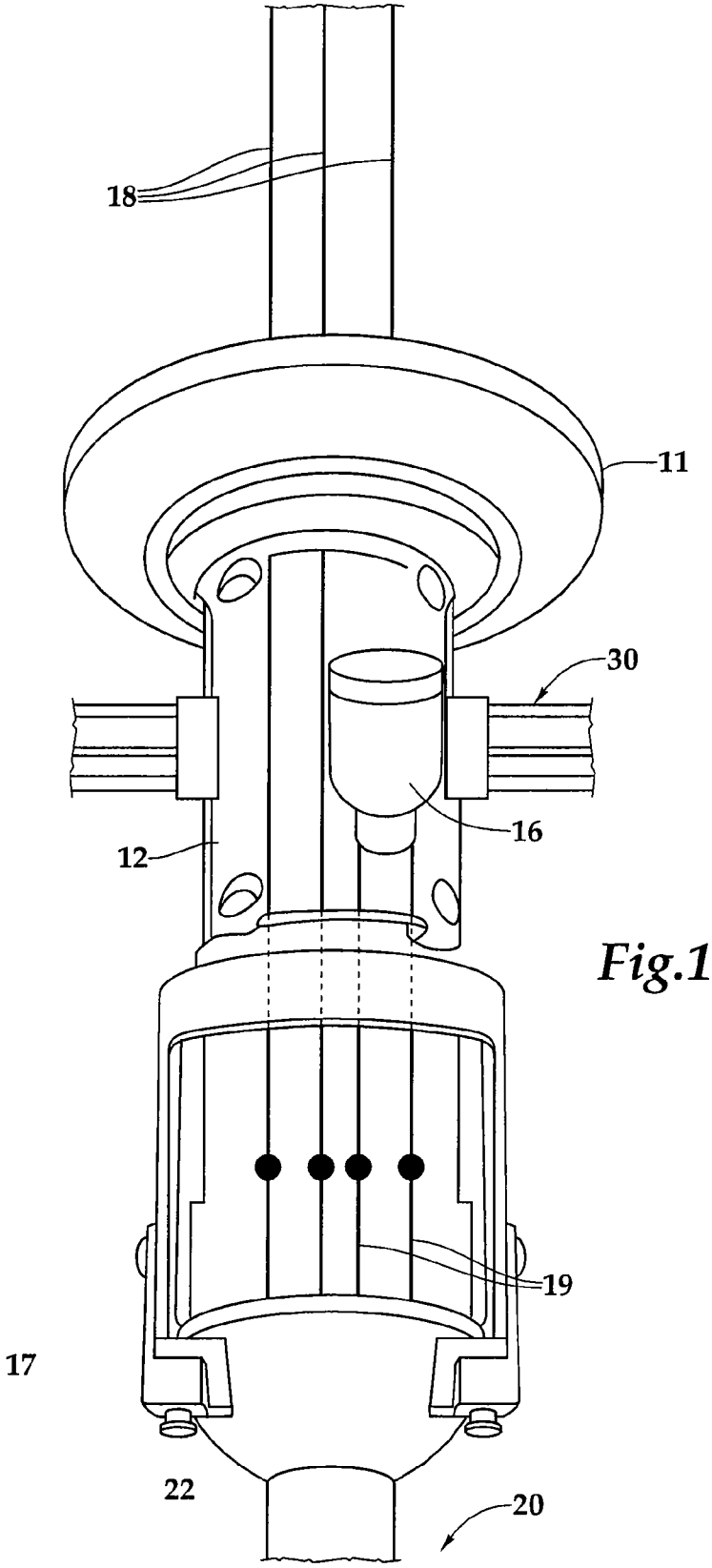
FIG. 1 is an embodiment of the invention.
Figure 2:
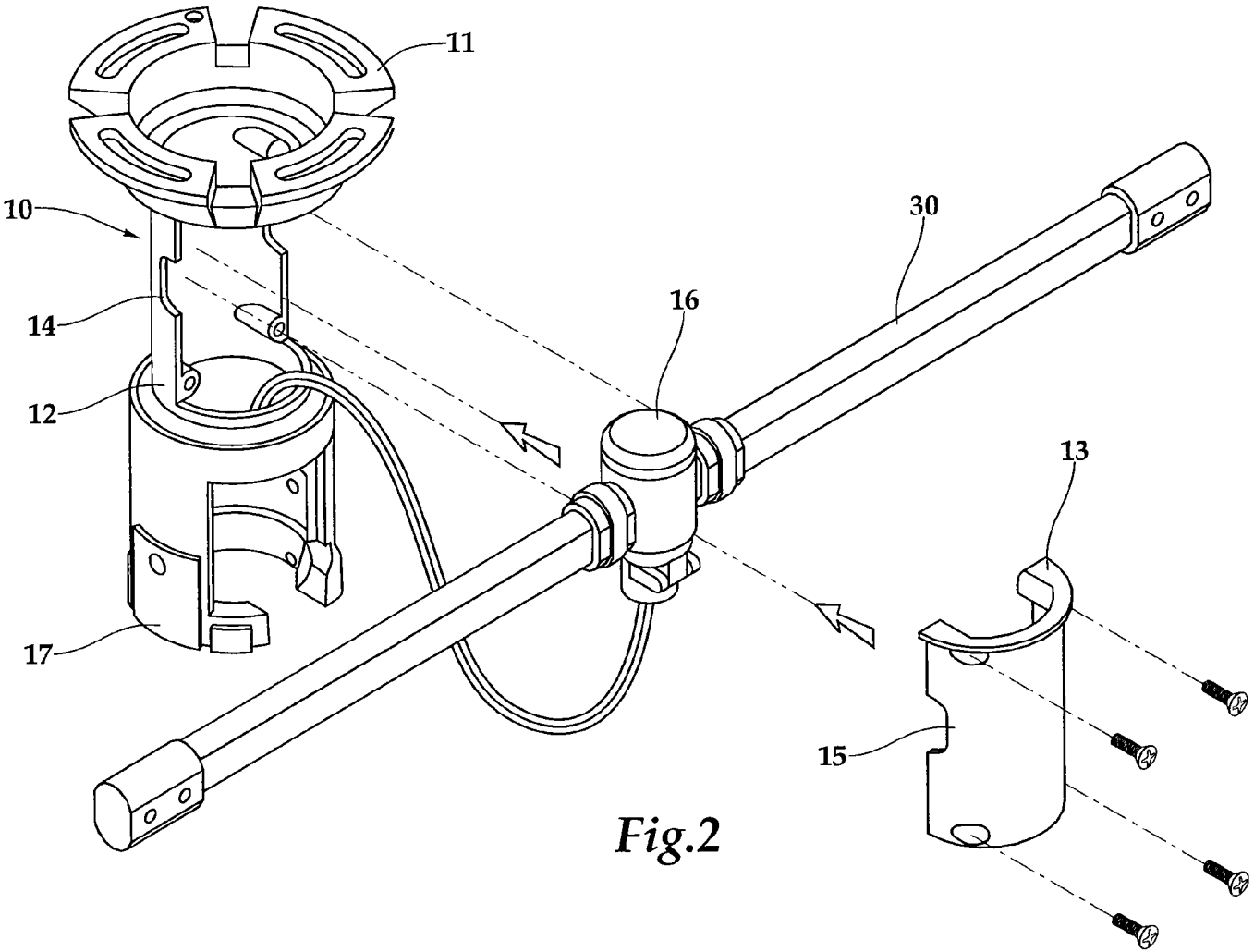
FIG. 2 is an enlarged exploded view showing an embodiment of the invention.

Referring to FIGS. 1 and 2, a combination ceiling fan and track light includes a support stem 10, a ceiling fan 20 (not fully shown) and a track light rail 30. In some embodiments, the support stem 10 includes a mounting ring 11 and a support tube 12 which includes a faceplate 13. The mounting ring 11 is coupled to the junction box in a ceiling (not shown) by attachment means. Some examples of attachment means include, but are not limited to, clamps, screws, and the like. The faceplate 13 is preferably removable from the support tube 12. The support tube 12 is coupled to the faceplate 13 by attachment means. Some examples of attachment means include, but are not limited to, clamps, screws, and the like. In a preferred embodiment, the mounting ring 11 and support tube 12 are fabricated from a single piece of material. Alternatively, the mounting ring 11 and support tube 12 may be fabricated from multiple pieces of material.

The support tube 12 further includes a hanging mechanism 17. In a preferred embodiment, the hanging mechanism 17 includes means for coupling to a standard hanger ball 22. The standard hanger ball 22 may be similar to those currently used in the mounting of ceiling fans to ceilings. Alternatively, the hanging mechanism 17 is any mechanism or hanger ball form which will couple the ceiling fan 20 to the support stem 10.

The support tube 12 is preferably hollow and capable of housing a power connector 16 and allowing for the passage of one or more electrical wires 18 from the junction box to the ceiling fan 20. The support tube 12 may include one or more notches 14. The faceplate 13 may include one or more notches 15. In a preferred embodiment, the notches 14 of the support tube 12 align with the notches 15 on the faceplate 13 and form an aperture allowing passage of the track light rail 30. The notches 14 and 15 may be of any shape which would accommodate any shape of the track light rail 30. The track light rail 30 may also be supported by ceiling standoffs (not shown) which are directly connected to the ceiling.

The power connector 16 is electrically coupled to one or more wires 19 from the ceiling fan 20. In a preferred embodiment, the wires 19 are similar to those supplied for a ceiling fan light kit. Where the ceiling fan is required to power both the track light and a ceiling fan light kit, wires 19 may be split to supply power to both such lights. In some embodiments, a voltage converter (not shown) is placed between wires 19 and power connector 16. The power connector 16 may be mechanically coupled to the track rail light 30 in certain embodiments. The power connector 16 is also electrically coupled to the track rail light 30. The power connector 16 may include a power transformer, in some embodiments, to transform the power from the ceiling fan to the appropriate voltage necessary for the track light rail 30.

The ceiling fan 20 is coupled to the ceiling by the support stem 10. The ceiling fan 20 is electrically coupled to the ceiling by standard electrical means, preferably wires 18. The ceiling fan 20 supplies the electricity to the track light rail 30 by the coupling of the wires 19 from the ceiling fan to the power connector 16. The materials of the support stem 10 include, but are not limited to, aluminum, steel, stainless steel, fiber reinforced plastics and any material able to support the forces encountered from an operating ceiling fan.

In some embodiments, the ceiling fan and track lighting may be operated by a remote control. The remote control may operate the ceiling fan's speed, whether the fan is on or off, the dimming of the ceiling fan wattage, whether the track fan is on or off, the dimming of the track lighting wattage, and any combination of these functions. Some exemplary remote controls which may be used include those described in U.S. Pat. Nos. 7,196,485 and 6,120,262, the contents of which are hereby incorporated by reference. The remote control may be similar to co-pending patent application Ser. No. 12/485,486 filed on Jun. 16, 2009 and assigned to the same owner, the contents of which are hereby incorporated by reference.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention, and it is further intended that each element or step recited is to be understood as referring to all equivalent elements or steps. The description is intended to cover the invention as broadly as legally possible in whatever forms it may be utilized.

I claim:

1. A combination ceiling fan and track light rail, comprising:

a support stem coupled to a ceiling;

a hanging mechanism coupled to the support stem and a ceiling fan, the ceiling fan electrically coupled to a junction box, wherein the support stem comprises a hollow tube;

a track light rail electrically coupled to the ceiling fan.

2. The combination ceiling fan and track light of claim 1, wherein the hanging mechanism comprises a standard hanger ball.

3. The combination ceiling fan and track light rail of claim 1, wherein the track light is electrically coupled to the ceiling fan by one or more wires from the ceiling fan.

4. The combination ceiling fan and track light rail of claim 3, wherein the one or more wires are connected to a transformer electrically coupled to the track light.

5. The combination ceiling fan and track light rail of claim 4, wherein the transformer transforms the line voltage to track light rail voltage.

6. The combination ceiling fan and track light rail of claim 1, wherein the support stem is coupled to the ceiling by the junction box.

7. The combination ceiling fan and track light of claim 1, wherein the hollow tube comprises a removable faceplate having apertures for allowing the track light rail to pass through the apertures.

8. The combination ceiling fan and track light of claim 1, wherein the support stem and hanging mechanism are fabricated from a single piece of material.

9. The combination ceiling fan and track light of claim 1, further comprising a remote control capable of operating the ceiling fan and track light.

* * * * *